US011332890B2

(12) United States Patent
McCulloch

(10) Patent No.: US 11,332,890 B2
(45) Date of Patent: May 17, 2022

(54) APPARATUS FOR LIFTING AND MOVING A RAIL

(71) Applicant: W & D MCCULLOCH LTD., Ballantrae (GB)

(72) Inventor: William Francis McCulloch, Ballantrae (GB)

(73) Assignee: W & D MCCULLOCH LTD., Ballantrae (GB)

( * ) Notice: Subject to any disclaimer, the term of this patent is extended or adjusted under 35 U.S.C. 154(b) by 496 days.

(21) Appl. No.: 16/316,933

(22) PCT Filed: Jul. 3, 2017

(86) PCT No.: PCT/GB2017/051958
§ 371 (c)(1),
(2) Date: Jan. 10, 2019

(87) PCT Pub. No.: WO2018/011545
PCT Pub. Date: Jan. 18, 2018

(65) Prior Publication Data

US 2019/0249373 A1 Aug. 15, 2019

(30) Foreign Application Priority Data

Jul. 12, 2016 (GB) ..... 1612063

(51) Int. Cl.
*E01B 29/17* (2006.01)
*E01B 33/00* (2006.01)
(Continued)

(52) U.S. Cl.
CPC ..... *E01B 29/17* (2013.01); *B66C 1/64* (2013.01); *E01B 29/02* (2013.01); *E01B 29/22* (2013.01); *E01B 31/18* (2013.01); *E01B 33/00* (2013.01)

(58) Field of Classification Search
CPC ..... E01B 29/17; E01B 29/02; E01B 29/22; E01B 31/18; E01B 33/00; E01B 29/00;
(Continued)

(56) References Cited

U.S. PATENT DOCUMENTS 3,120,819 A * 2/1964 Gammie ..... E01B 29/17 104/5
3,199,462 A * 8/1965 Hooker ..... E01B 29/17 104/2
3,635,164 A * 1/1972 Patton ..... E01B 29/17 104/307

FOREIGN PATENT DOCUMENTS

CH 641858 A5 3/1984
DE 2237159 A1 * 7/1972 ..... E01B 29/16
(Continued)

OTHER PUBLICATIONS

Fernandez, Eva, "International Search Report," prepared for PCT/GB2017/051958, as dated Sep. 12, 2017, four pages.

*Primary Examiner* — S. Joseph Morano
*Assistant Examiner* — Cheng Lin
(74) *Attorney, Agent, or Firm* — Edell, Shapiro & Finnan, LLC

(57) ABSTRACT

A rail lifting head (10) comprises a head gate member (20) defining a gate aperture (22), a rail support member (24) removably secured to the gate member (20) and adapted to support a rail vertically within the gate aperture (22), and a head cartridge (100) which is removably secured to the head gate member (20). The head cartridge (100) includes two opposed vertical rollers (128) which support a rail laterally within the gate aperture and a fixing (112) which secures the head cartridge (100) to the head gate member (20). The rail support member (24) is removable from the head gate member (20).

17 Claims, 7 Drawing Sheets

(51) Int. Cl.

| | |
|---|---|
| ***E01B 29/22*** | (2006.01) |
| ***B66C 1/64*** | (2006.01) |
| ***E01B 29/02*** | (2006.01) |
| ***E01B 31/18*** | (2006.01) |

(58) Field of Classification Search
CPC ..... E01B 29/16; E01B 29/20; E01B 2203/10; E01B 2203/122; B66C 1/64
USPC ..... 104/5
See application file for complete search history.

(56) References Cited

FOREIGN PATENT DOCUMENTS

| | | | | | |
|---|---|---|---|---|---|
| DE | 2237159 | A1 | | 2/1974 | |
| EP | 1733096 | A1 | | 12/2006 | |
| GB | 2160919 | A | * | 1/1986 | ..... E01B 29/17 |
| WO | WO-2005095716 | A1 | * | 10/2005 | ..... E01B 29/16 |

* cited by examiner

APPARATUS FOR LIFTING AND MOVING A RAIL

FIELD OF INVENTION

The present invention relates to apparatus for lifting and moving a railway rail and a method of lifting and moving railway rails using such apparatus.

BACKGROUND TO INVENTION

Railway maintenance may involve replacing railway rails when they are worn. It is known within the railway maintenance industry to use apparatus that runs on an existing railway to lift worn rails and lay replacement rails. Recent years have seen the introduction of trackside rail handling apparatus, which can lift and transpose rails without having to use apparatus which runs on a railway.

EP1733096A discloses a railway rail handling apparatus for lifting and transposing railway rails. A rail moving means depends from a chassis supported on two spaced apart support frames, which are each supported on a continuous chain tread. On the chassis are supported a pneumatic system, a diesel generator and a user control, which provide pneumatic actuation, generation and user control of the railway rail handling apparatus in accordance with known techniques. The diesel generator provides motive power for the railway rail handling apparatus.

The rail moving means comprises an elongate telescopic body, the upper part of which is mounted on the chassis by means of a coupling, which provides for swivelling and/or rotation of the rail moving means relative to the chassis. A pin can be inserted by an operator into an upper part of the rail moving means to arrest swivelling and/or rotation relative to the chassis.

At the lower end of the rail moving means there is provided a lifting head for accommodating a rail. The lifting head has two spaced apart side members extending down from a top plate and defining an aperture, and a lower roller spaced from the top plate and extending between the two side members. A rail can be lifted into the aperture with the roller removed, and the roller replaced while the rail is held in the aperture. The rail is then lowered to be supported by the roller and engaged by the lifting head. As the apparatus moves along the ground, the lifting head urges the rail to move laterally to align the rail to the position of the lifting head. The aperture is of sufficient dimensions to accommodate discontinuities and projections encountered on a surface of a rail, as the rail moving means is moved along the rail. In this known apparatus different lifting heads must be fitted to the railway rail handling apparatus for moving different types of rail.

It is an object of the present invention to provide an apparatus which enables a railway rail handling apparatus means to lift and move different types of rail without having to fit a different lifting head for different types of rail.

According to a First Aspect of the Present Invention there is Provided a Rail Lifting Head Comprising:

- a head gate member defining a gate aperture,
- a rail support member removably secured to the gate member and adapted to support a rail vertically within the gate aperture, and
- a head cartridge adapted to be removably secured to the head gate member, wherein the head cartridge includes two opposed vertical rollers adapted to support a rail laterally within the gate aperture and a fixing adapted to removably secure the head cartridge to the head gate member.

The rail support member may be removable from the head gate member, either fully or partially, by rotation, swinging, sliding, lifting or any other suitable movement.

The head cartridge may be adapted to suit a particular type of rail, and may be replaced by a different head cartridge when the rail lifting head is used with a different type of rail, without having to replace the entire rail lifting head. Instead it is necessary only to use a different head cartridge.

The opposed vertical rollers may each extend between a lower horizontal plate and a common top plate of the head cartridge.

The opposed vertical rollers may each be mounted for rotation about a vertical axis of rotation.

Typically the vertical rollers may be between 100 and 150 mm in length.

The head cartridge may include two pairs of opposed vertical rollers, wherein the vertical axes of rotation are arranged to form a rectangular grid in plan.

The rail support member may comprise a roller mounted for rotation on a horizontal axis.

The rail support member may be adapted for rotation about a vertical axis at one end of the rail support member, such that the gate aperture may be opened and the lowered over a rail.

The head gate member may include a head top plate.

The head gate member may include two side walls extending down from the head top plate.

The rail support member may be coupled at a first hinge end of the rail support member to a first vertical shaft member which is mounted on the head top plate for rotation about a vertical axis, and which depends from the head top plate.

The head gate member may comprise a first head lever extending above the head top plate and rotationally fixed to the first vertical shaft member for controlling rotation of the first vertical shaft member.

The first head lever may have a clamp member hingedly attached thereto and selectively engageable with a fixing slot in the head top plate to lock the first vertical shaft member against rotation.

The rail support member may be selectively retainable at a second end of the rail support member to a second vertical shaft member which is mounted on the head top plate for rotation about a vertical axis, and which depends from the head top plate.

The second end of the rail support member may be engageable in an aperture provided at the lower end of the second vertical shaft member. The rail support member may comprise a locking pin adapted to lock the second end of the rail support member in the aperture provided at the lower end of the second vertical shaft member The head gate member may comprise a second head lever extending above the head top plate and rotationally fixed to the second vertical shaft member for controlling rotation of the second vertical shaft member.

The second head lever may have a clamp member hingedly attached thereto and selectively engageable with a fixing slot in the head top plate to lock the second vertical shaft member against rotation.

The head cartridge may be adapted to suit a tram rail. The head cartridge may include two pairs of opposed vertical rollers, each pair being spaced apart by between 150 and 250 mm, preferably about 200 mm, in the direction of the rail. Each pair of rollers may be spaced apart transversely by between 150 and 200 mm, preferably about 175 mm. Spacings are preferably measured from axis to axis. The fixing adapted to removably secure the head cartridge to the head gate member may be adapted to secure the top plate of the head cartridge in close proximity to the head top plate of the head gate member.

The head cartridge may be adapted to suit a standard rail. The head cartridge may include two pairs of opposed vertical rollers, each pair being spaced apart by between 50 and 150 mm, preferably about 100 mm, in the direction of the rail. Each pair of rollers may be spaced apart transversely by between 100 and 150 mm, preferably about 125 mm. The fixing adapted to removably secure the head cartridge to the head gate member may be adapted to secure the top plate of the head cartridge in close proximity to the head top plate of the head gate member.

The head cartridge may be adapted to suit a conductor rail. The head cartridge may include two pairs of opposed vertical rollers, each pair being spaced apart by between 50 and 150 mm, preferably about 100 mm, in the direction of the rail. Each pair of rollers may be spaced apart transversely by between 110 and 170 mm, preferably about 139 mm. The fixing adapted to removably secure the head cartridge to the head gate member may be adapted to secure the top plate of the head cartridge at a spacing of between 25 and 50 mm from the head top plate of the head gate member.

The head cartridge may be adapted to suit a bullhead rail. The head cartridge may include two pairs of opposed vertical rollers, each pair being spaced apart by between 50 and 150 mm, preferably about 100 mm, in the direction of the rail. Each pair of rollers may be spaced apart transversely by between 100 and 150 mm, preferably about 120 mm. One pair of rollers may be longer than the other pair of rollers. Typically one pair of rollers may be between 100 and 150 mm in length. Typically the other pair of rollers may be between 225 and 275 mm in length. The fixing adapted to removably secure the head cartridge to the head gate member may be adapted to secure the top plate of the head cartridge at a spacing of between 25 and 50 mm from the head top plate of the head gate member.

The fixing may comprise one or more lugs attached to the top plate of the head cartridge and adapted to engage with associated slots provided in the head top plate of the head gate member. Each lug may be provided with an aperture adapted to receive a locking pin.

According to a second aspect of the present invention there is provided a rail lifting apparatus comprising a rail lifting head according to the first aspect of the present invention, including a plurality of head cartridges each adapted to be removably secured to the head gate member, wherein each head cartridge includes two opposed vertical rollers adapted to support a rail laterally within the gate aperture and a fixing adapted to removably secure the head cartridge to the head gate member.

The head cartridges may comprise one or more of each of a head cartridge adapted to suit a tram rail, as described in the first embodiment, a head cartridge adapted to suit a standard rail, as described in the first embodiment, a head cartridge adapted to suit a conductor rail, as described in the first embodiment, and/or a head cartridge adapted to suit a bullnose rail, as described in the first embodiment.

According to a third aspect of the present invention there is provided a method of lifting a rail using a rail lifting head according to the first aspect of the present invention, the method including the steps of:

securing the head cartridge to the head gate member using the fixing;

opening the gate aperture of the head gate member by removing or rotating the rail support member;

lowering the gate aperture over a portion of a rail raised above the ground;

closing the gate aperture of the head gate member by replacing or rotating the rail support member beneath the portion of the rail; and raising the rail lifting head to lift the rail on the rail support member.

BRIEF DESCRIPTION OF THE DRAWINGS

The invention will be described, by way of example only, with reference to the drawings in which.

DESCRIPTION OF SPECIFIC EMBODIMENTS

Figure 1:
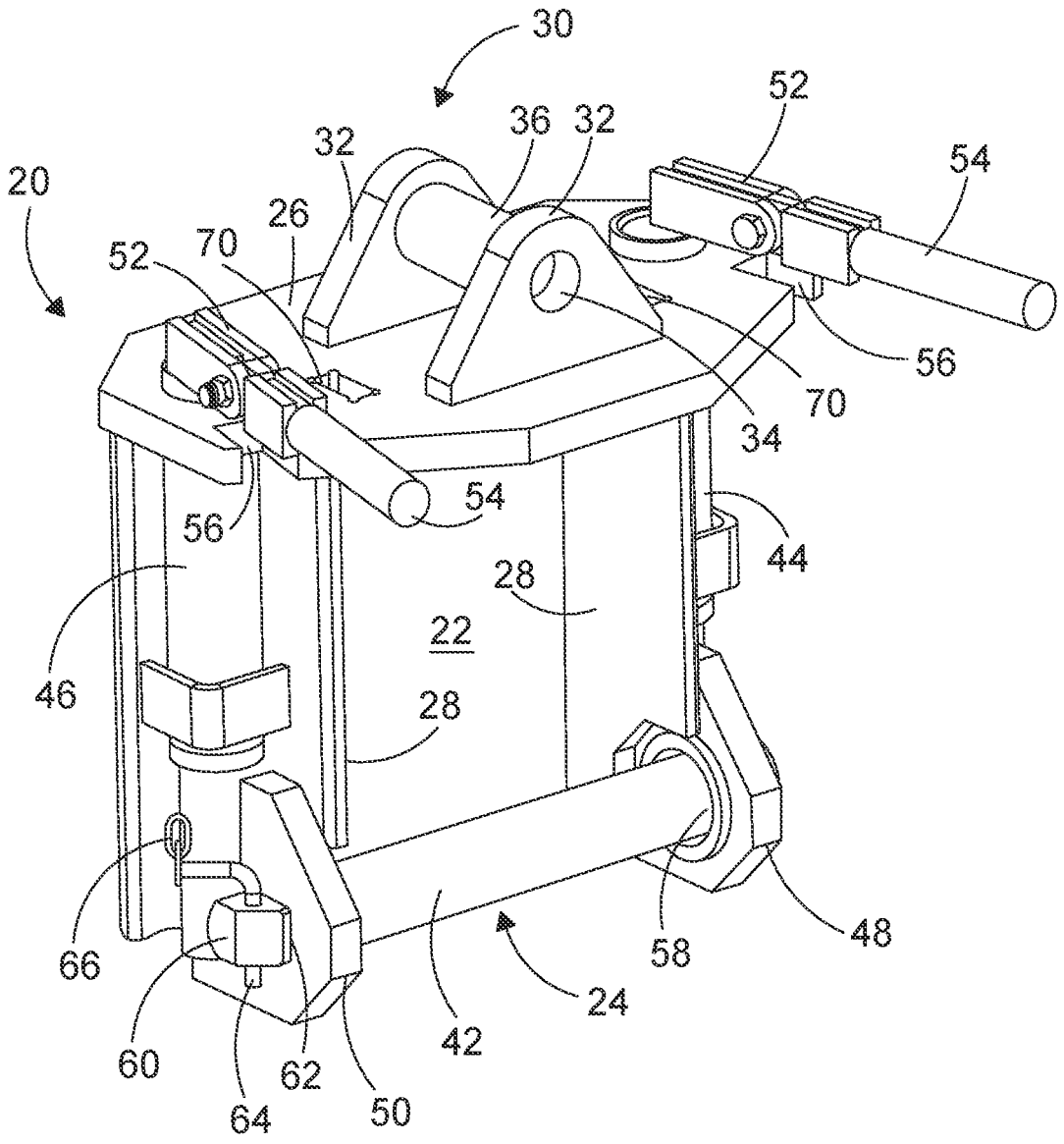
FIG. 1 shows a perspective view of a head gate member of a rail lifting head according to an embodiment of the present invention.
Figure 6:
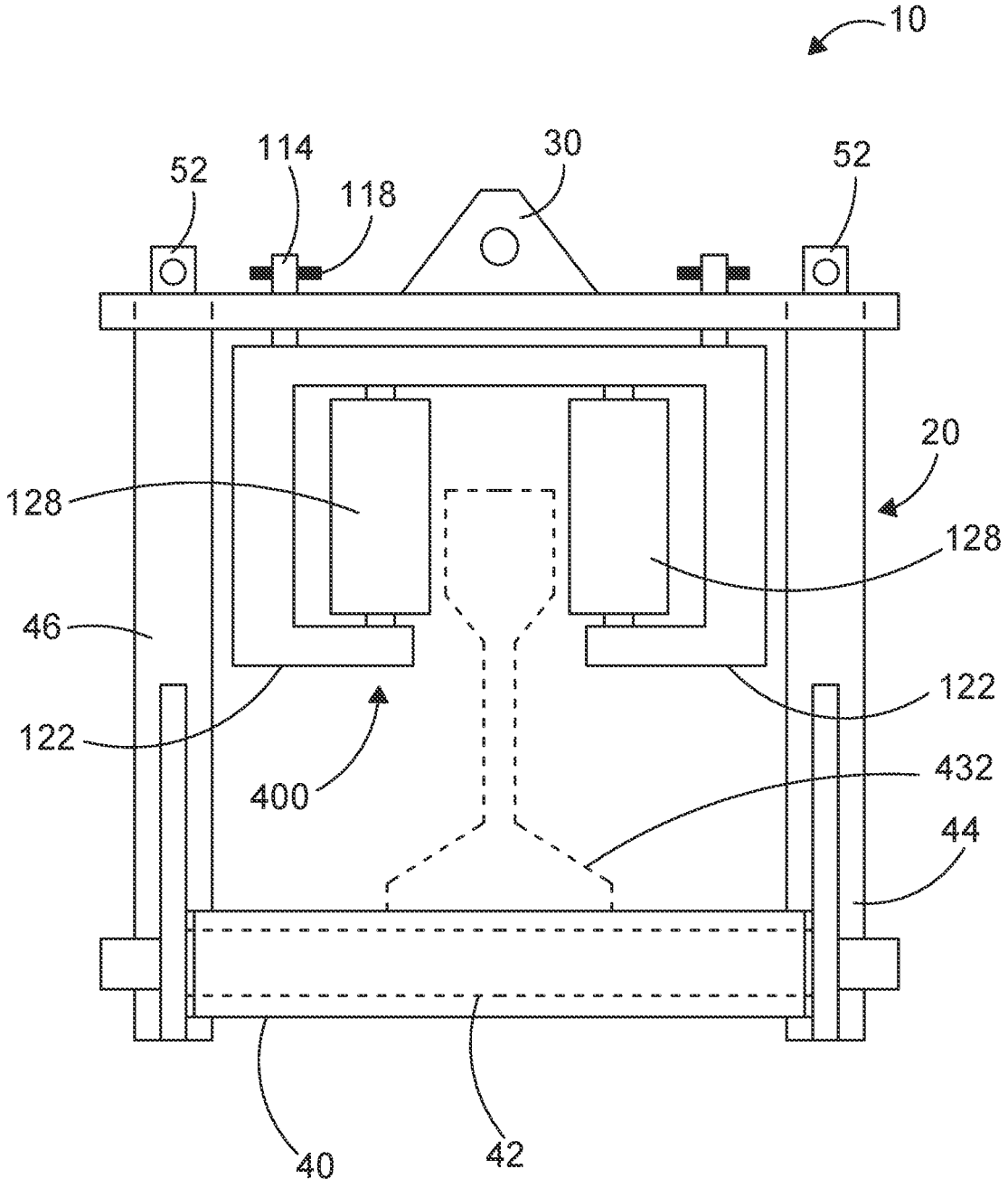
FIG. 6 is a schematic elevation view of the head cartridge of FIG. 4 or 5 mounted in the head gate member of FIG. 1.
Figure 7:
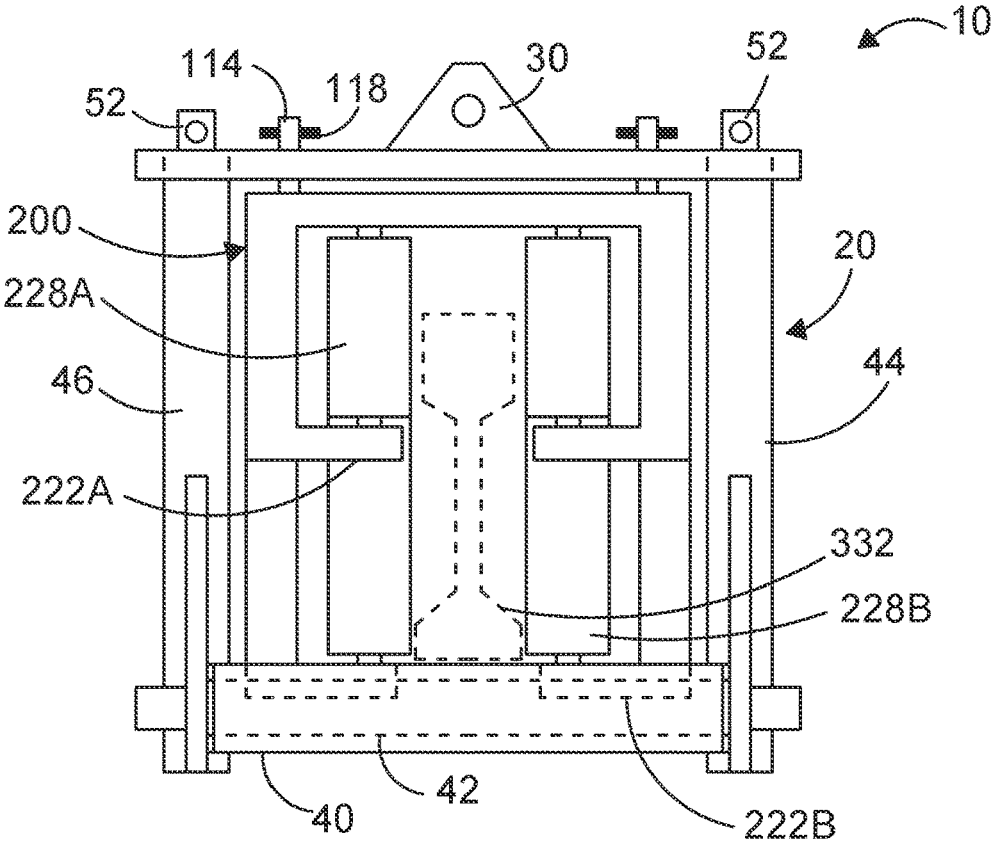
FIG. 7 is a schematic elevation view of the head cartridge of FIG. 3 mounted in the head gate member of FIG. 1.
Figure 8:
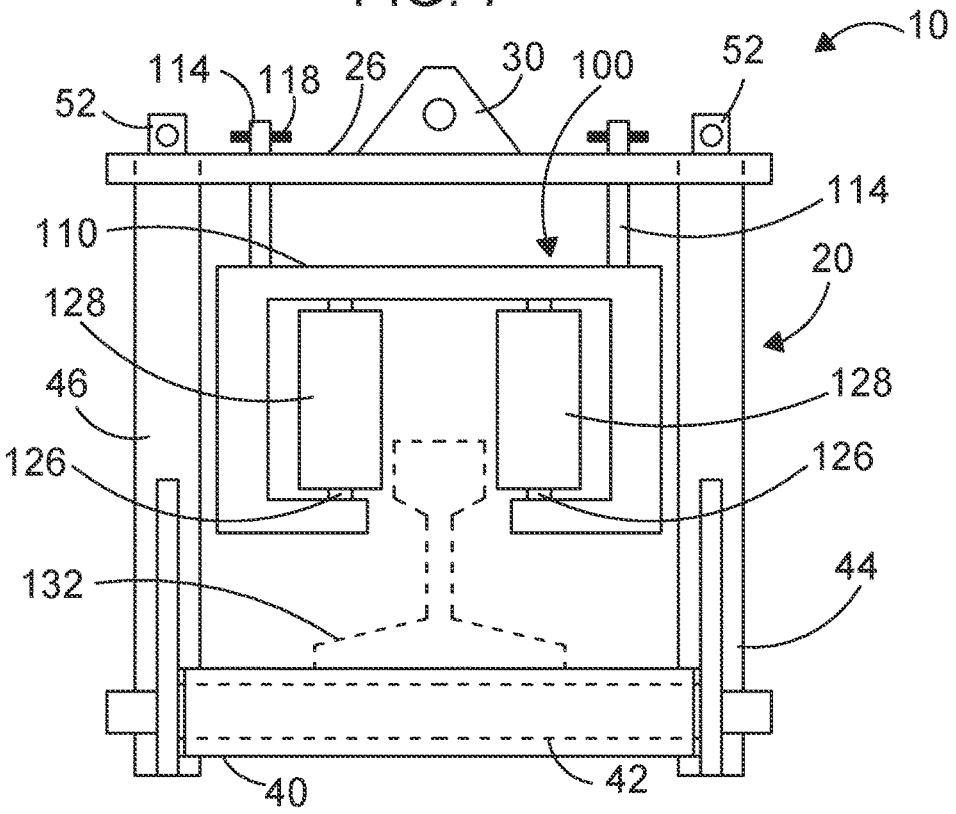
FIG. 8 is a schematic elevation view of the head cartridge of FIG. 2 mounted in the head gate member of FIG. 1.

With reference to FIG. 1 there is shown a head gate member 20 of a rail lifting head 10 (which is best shown in FIGS. 6-8) according to the present invention. The head gate member 20 defines a gate aperture 22, the bottom of which is defined by a rail support member 24 removably secured to the gate member 20 and adapted to support a rail vertically within the gate aperture 22.

The head gate member 20 comprises a head top plate 26 and two side walls 28 extending down from the head top plate 26, on either side of the gate aperture 22. A lifting arrangement 30 comprising two lifting lugs 32 is fixed to the top of the head top plate 26. The lugs 32 have apertures 34 connected by a tube 36 through which a pin (not shown) of a telescopic body of a railway rail handling apparatus, such as that disclosed in EP1733096A, can be inserted, to lift the rail lifting head 10. However any appropriate lifting arrangement may be provided.

The rail support member 24 comprises a roller 40 (omitted in FIG. 1, but shown in FIGS. 6 to 8) mounted for rotation on a horizontal shaft 42.

First and second vertical shaft members 44, 46 are rotatably mounted on the head top plate 26 outside the side walls 28. Each vertical shaft member 44, 46 extends downwards from the head top plate 26 and has a mounting plate 48, 50 at its lower end. Each vertical shaft member 44, 46 has a corresponding head lever 52 extending above the head top plate 26 and pivotally connected to the vertical shaft member 44, 46 for controlling rotation of the vertical shaft member 44, 46. Each head lever 52 has a clamp member 54 hingedly attached thereto and selectively engageable with a fixing slot 56 in the head top plate 26 to lock the vertical shaft member 44, 46 against rotation. In FIG. 1 the clamp member 54 is shown in the raised, unlocked position, but it is to be understood that if the clamp member 54 were to be lowered, it would engage with the fixing slot 56 to prevent axial rotation of the associated vertical shaft member 44, 46.

The first vertical shaft member 44 has a first end 58 of the horizontal shaft 42 of the rail support member 24 fixed in the mounting plate 48. A second end 60 of the horizontal shaft 42 engages an aperture 62 in the mounting plate 50 at the lower end of the second vertical shaft member 46. To open the gate aperture 22 a locking pin 64 is removed from the second end 60 of the horizontal shaft 42, and by rotating the head lever 52 of the second vertical shaft member 46, the second end 60 is withdrawn from the aperture 62 in the mounting plate 50. The locking pin 64 may be secured to the second vertical shaft member 46 by a chain 66 or similar.

Then, by rotating the head lever 52 of the first vertical shaft member 44, the rail support member 24 swings forward to open the gate aperture 22.

The rail support member 24 may be supported by other appropriate means, and may be removable not only by rotation, but instead by sliding or lifting, or a combination of sliding, lifting and/or rotation.

The head top plate 26 has two slots 70 adapted to receive the lugs of a head cartridge 100, as described below.

Figure 2:
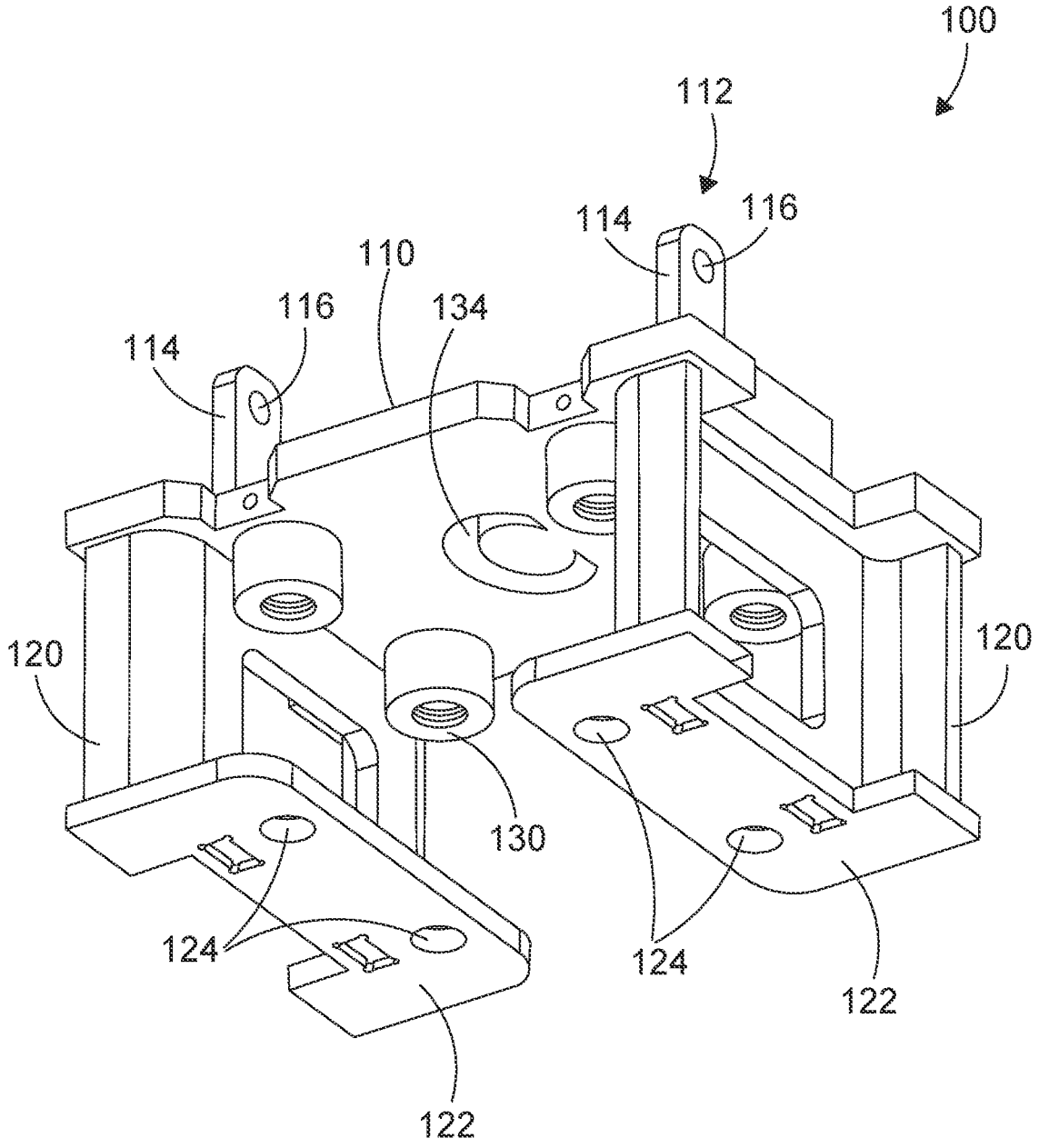
FIG. 2 shows a perspective view of a head cartridge of a rail lifting head according to an embodiment of the present invention for lifting a conductor rail.

FIG. 2 shows a head cartridge 100 which is adapted to be removably secured to the head gate member 20 shown in FIG. 1. FIG. 8 illustrates the head cartridge of FIG. 2 mounted in the head gate member 20 of FIG. 1 in schematic form, with the side walls 28 of the head gate member 20 omitted for clarity.

The head cartridge 100 has a top plate 110 to which is attached a fixing 112 comprising two lugs 114. The lugs 114 are adapted to engage with the associated slots 70 provided in the head top plate 26 of the head gate member 20. Each lug 114 has an aperture 116 adapted to receive a locking pin 118 (shown in FIG. 8).

The head cartridge 100 has two side walls 120 and two lower horizontal plates 122, each fixed to the bottom of a corresponding side wall 120 and spaced from the top plate 110. Each lower plate 122 has two apertures 124, each aperture 124 being adapted to receive a roller shaft 126 of a vertical roller 128. The rollers 128 are omitted for clarity in FIG. 2, but shown in FIG. 8. The upper end of each roller shaft 126 is received in a socket 130 provided on the underside of the top plate 110.

In the embodiment of FIG. 2, there are two pairs of opposed vertical rollers 128 adapted to support a conductor rail 132 laterally within the gate aperture 22. The top plate 110 includes a marking 134, in this case a letter "C" denoting "conductor rail" to aid identification of the appropriate head cartridge 100 when lifting and/or moving a rail.

The opposed vertical rollers 128 are each mounted for rotation about a vertical axis of rotation, and are typically between 100 and 150 mm in length.

In the embodiment of FIG. 2 the head cartridge 100 includes two pairs of opposed vertical rollers 128, wherein the vertical axes of rotation are arranged to form a rectangular grid in plan. The axes of rotation are spaced apart by between 50 and 150 mm, preferably about 100 mm, in the direction of the rail, and by between 125 and 175 mm, preferably about 150 mm, in the direction transverse to the rail. In a variation a single pair of opposed vertical rollers 128 may be provided instead.

The fixing 112 adapted to removably secure the head cartridge 100 to the head gate member 20 is adapted to secure the top plate 110 of the head cartridge 100 at a spacing of between 25 and 50 mm from the head top plate 26 of the head gate member 20, as seen in FIG. 8, so that the rail lifting head 10 fits and provides adequate support to a conductor rail.

Different head cartridges 100 may be used with a single rail lifting head 10. Each head cartridge 100 may be adapted to suit a particular type of rail, and may be replaced by a different head cartridge 100 when the rail lifting head is used with a different type of rail, without having to replace the rail lifting head 10.

Figure 3:
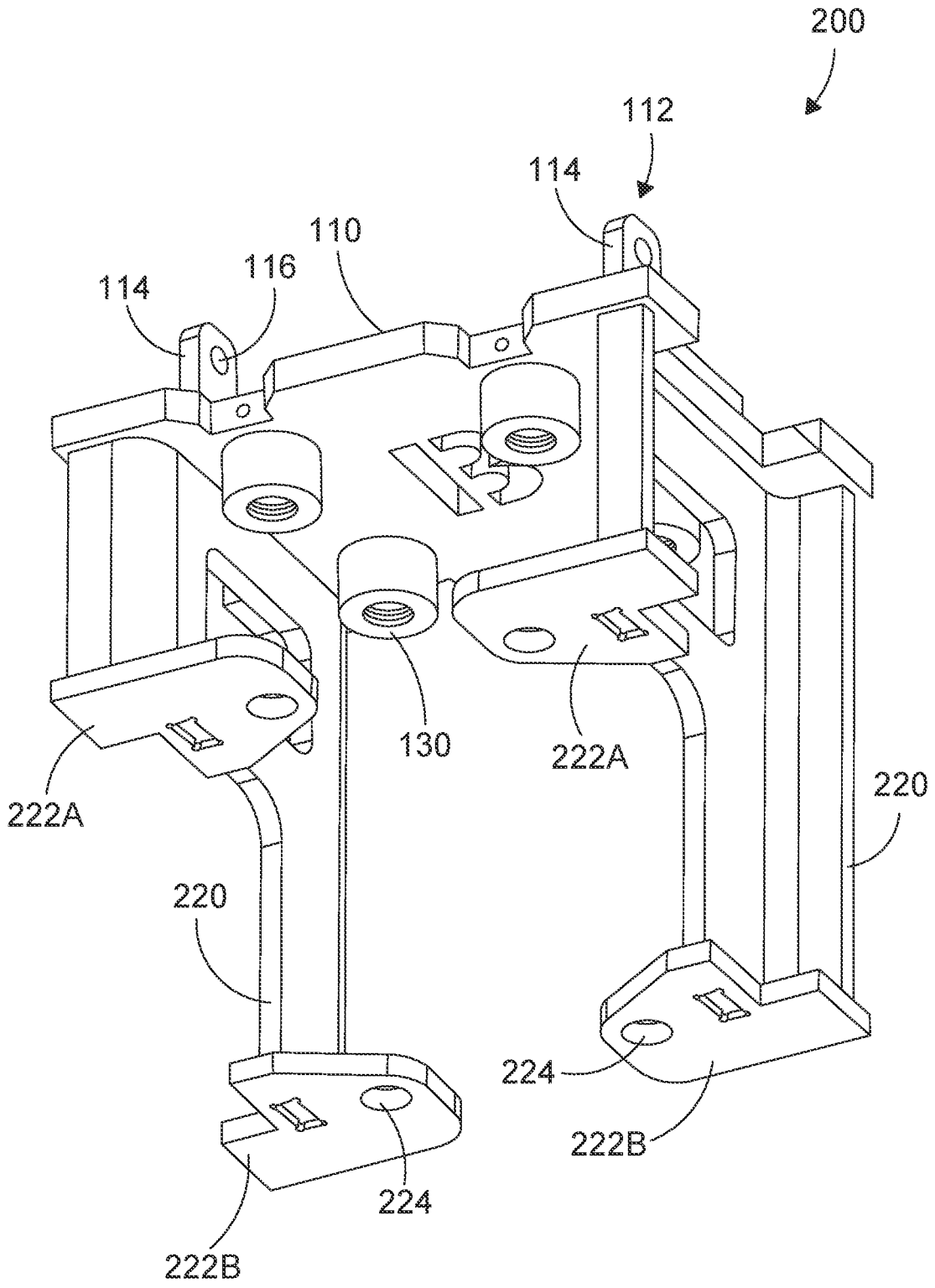
FIG. 3 shows a perspective view of a head cartridge of a rail lifting head according to an embodiment of the present invention for lifting a bullhead rail.

FIG. 3 shows another head cartridge 200 which is adapted to be removably secured to the head gate member 20 shown in FIG. 1. FIG. 7 illustrates the head cartridge 200 of FIG. 3 mounted in the head gate member 20 of FIG. 1 in schematic form, with the side walls 28 of the head gate member 20 omitted for clarity.

The head cartridge 200 is similar in most aspects to the head cartridge 100 of FIG. 2 and like components are provided with the same reference numeral.

The head cartridge 200 has two side walls 220 and four lower horizontal plates 222A, 222B, each fixed to the bottom of a corresponding side wall 220 and spaced from the top plate 110. Each lower plate 222A, 222B has an aperture 224, each aperture 224 being adapted to receive a roller shaft 226 of a vertical roller 228A, 228B. The rollers 228A, 228B are omitted for clarity in FIG. 3, but shown in FIG. 7. The upper end of each roller shaft 226 is received in a socket 130 provided on the underside of the top plate 110.

In the embodiment of FIG. 3, there is one pair of shorter opposed vertical rollers 228A and one pair of longer opposed vertical rollers 228B adapted to support a bullhead rail 232 laterally within the gate aperture 22. The top plate 110 includes a marking 134, in this case a letter "B" denoting "bullhead rail" to aid identification of the appropriate head cartridge 200 when lifting and/or moving a rail.

The opposed vertical rollers 228A, 228B are each mounted for rotation about a vertical axis of rotation. The shorter opposed vertical rollers 228A are typically between 100 and 150 mm in length. The longer opposed vertical rollers 228B are typically between 200 and 300 mm in length.

The axes of rotation of the rollers 228A, 228B are spaced apart by between 50 and 150 mm, preferably about 100 mm, in the direction of the rail, and by between 125 and 175 mm, preferably about 150 mm, in the direction transverse to the rail.

The fixing 112 adapted to removably secure the head cartridge 200 to the head gate member 20 is adapted to secure the top plate 110 of the head cartridge 100 close to the head top plate 26 of the head gate member 20, as seen in FIG. 7, so that the rail lifting head 10 fits and provides adequate support to a bullhead rail, which is taller than a conductor rail.

Figure 4:
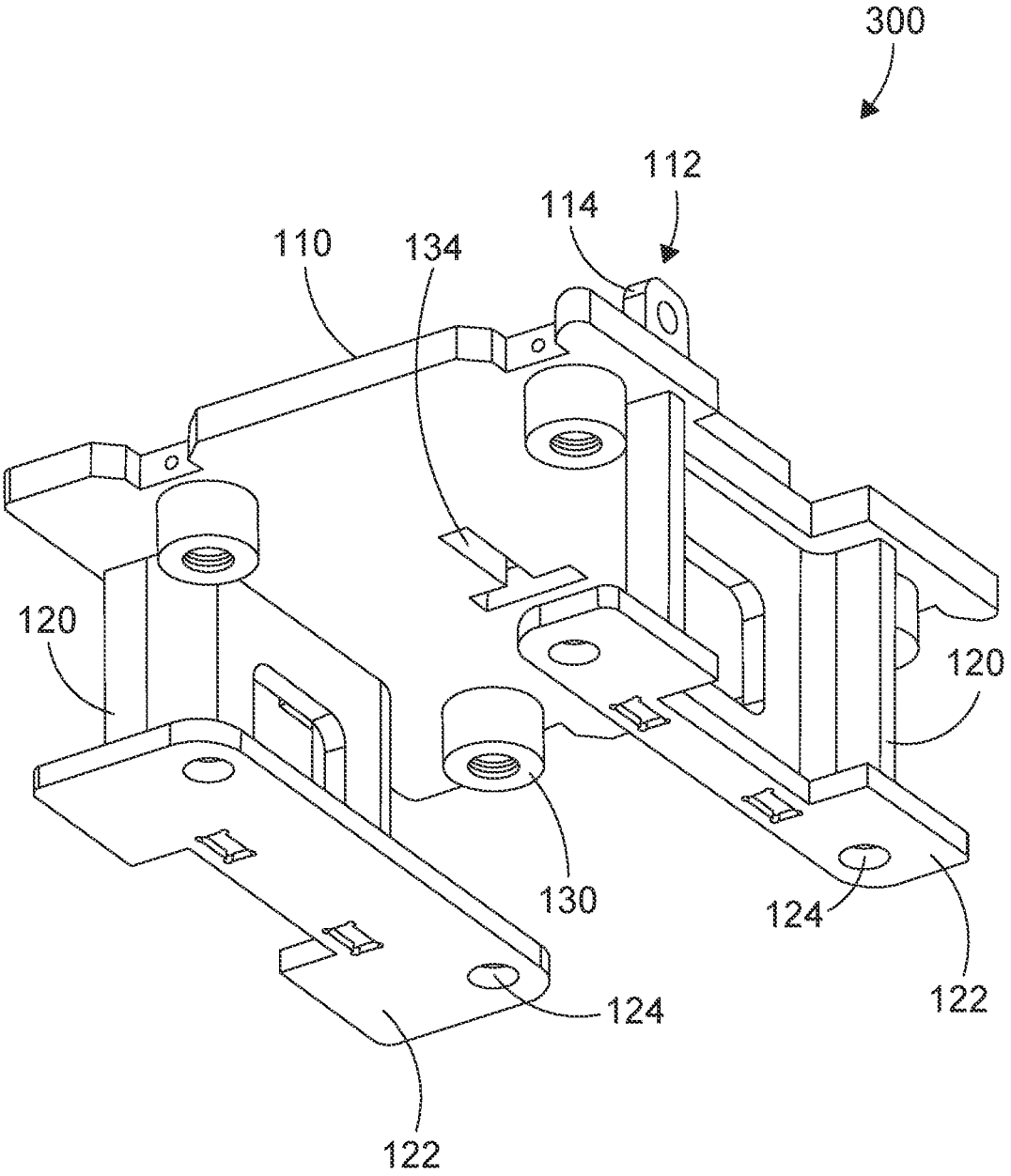
FIG. 4 shows a perspective view of a head cartridge of a rail lifting head according to an embodiment of the present invention for lifting a tram rail.

FIG. 4 shows another head cartridge 300 which is adapted to be removably secured to the head gate member 20 shown in FIG. 1. FIG. 6 illustrates the head cartridge 300 of FIG. 4 mounted in the head gate member 20 of FIG. 1 in schematic form, with the side walls 28 of the head gate member 20 omitted for clarity.

The head cartridge 300 is similar in most aspects to the head cartridge 100 of FIG. 2 and like components are provided with the same reference numeral. The difference is that the head cartridge 300 is designed for a tram rail, which has similar overall dimensions but different shape, to the standard rail 432 illustrated in FIG. 6, and the head cartridge is longer in the direction of the rail. The top plate 110 includes a marking 134, in this case a letter "T" denoting "tram rail" to aid identification of the appropriate head cartridge 300 when lifting and/or moving a rail.

The axes of rotation of the rollers 128 are spaced apart by between 150 and 250 mm, preferably about 200 mm, in the direction of the rail, and by between 150 and 200 mm, preferably about 173 mm, in the direction transverse to the rail. Although not shown in FIG. 6, one of the lower plates 122 may be narrower, to achieve the larger transverse spacing of the rollers than is required for a standard rail 432.

The fixing 112 adapted to removably secure the head cartridge 300 to the head gate member 20 is adapted to secure the top plate 110 of the head cartridge 100 close to the head top plate 26 of the head gate member 20, as seen in FIG. 6, so that the rail lifting head 10 fits and provides adequate support to a tram rail, which is taller than a conductor rail.

Figure 5:
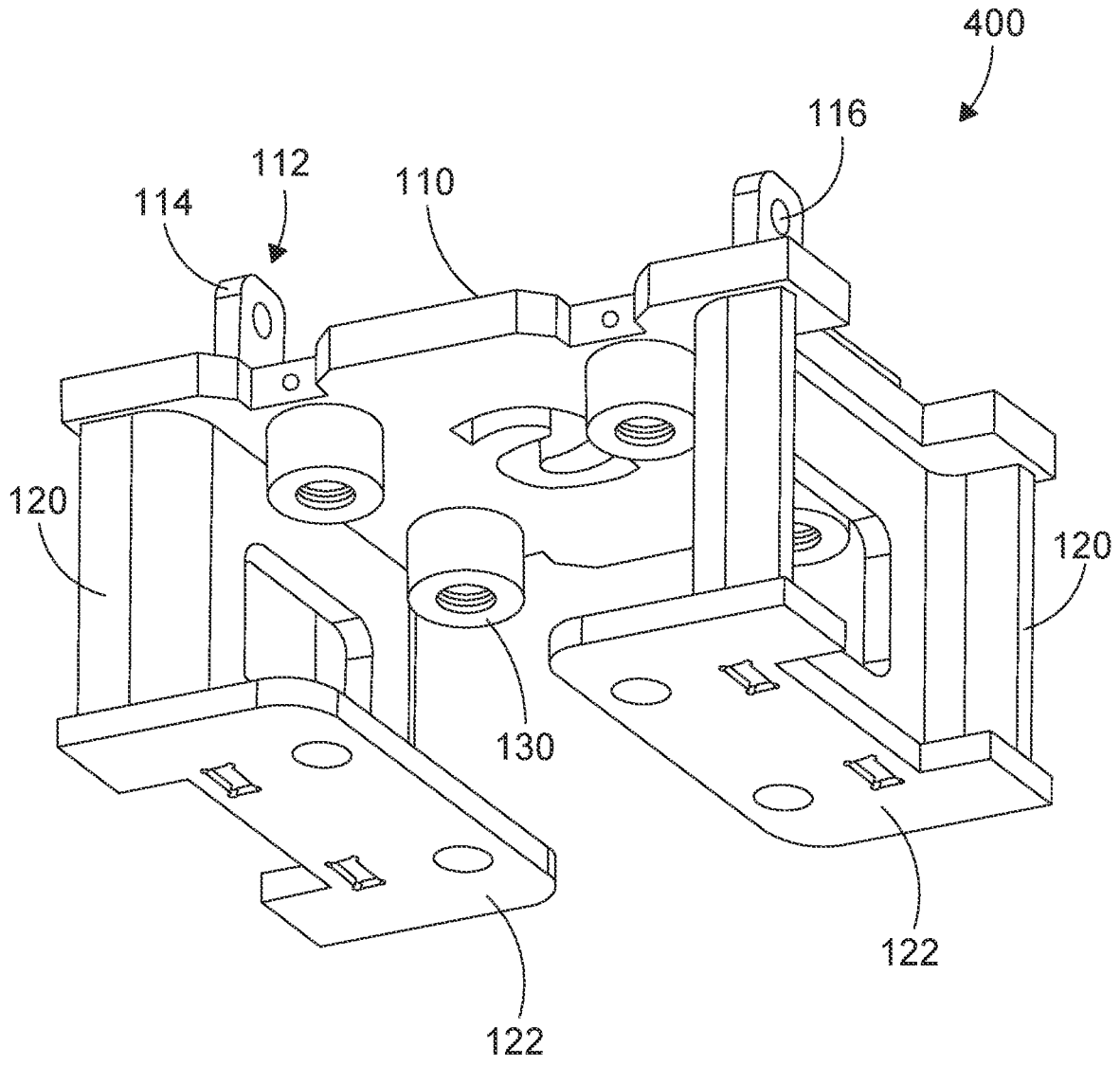
FIG. 5 shows a perspective view of a head cartridge of a rail lifting head according to an embodiment of the present invention for lifting a standard rail.

FIG. 5 shows another head cartridge 400 which is adapted to be removably secured to the head gate member 20 shown in FIG. 1. FIG. 6 illustrates the head cartridge 400 of FIG. 5 mounted in the head gate member 20 of FIG. 1 in schematic form, with the side walls 28 of the head gate member 20 omitted for clarity.

The head cartridge 400 is similar in most aspects to the head cartridge 100 of FIG. 2 and like components are provided with the same reference numeral. The difference is that the head cartridge 400 is designed for a standard rail 432, and the head cartridge is designed to fit higher within the gate aperture 22. The top plate 110 includes a marking 134, in this case a letter "S" denoting "standard rail" to aid identification of the appropriate head cartridge 400 when lifting and/or moving a rail.

The axes of rotation of the rollers 128 are spaced apart by between 75 and 125 mm, preferably about 100 mm, in the direction of the rail, and by between 110 and 170 mm, preferably about 139 mm, in the direction transverse to the rail. The fixing 112 adapted to removably secure the head cartridge 300 to the head gate member 20 is adapted to secure the top plate 110 of the head cartridge 100 close to the head top plate 26 of the head gate member 20, as seen in FIG. 6, so that the rail lifting head 10 fits and provides adequate support to a standard rail, which is taller than a conductor rail.

In use a rail lifting apparatus is supplied, comprising a rail lifting head and a plurality of head cartridges, each adapted to be removably secured to the head gate member, wherein the head cartridges comprise one or more of each of a head cartridge adapted to suit a tram rail, a head cartridge adapted to suit a standard rail, a head cartridge adapted to suit a conductor rail, and/or a head cartridge adapted to suit a bullnose rail.

The method of lifting or moving a rail using the rail lifting head of the present invention is as follows:

1. The head cartridge 100 is lifted up to the head gate member 20 and secured to the head gate member 20 by engaging the lugs 114 of the fixing 112 in the slots 70 in the head top plate 26 and inserting the locking pins 118 in the apertures 116 of the lugs.

2. The gate aperture 22 of the head gate member 20 is opened by removing or rotating the rail support member 24.

3. The gate aperture 22 is lowered over a portion of a rail raised above the ground.

4. The gate aperture 22 of the head gate member 20 is closed by replacing or rotating the rail support member 24 beneath the portion of the rail.

5, The rail lifting head 10 is raised to lift the rail on the rail support member 24.

The invention provides a simple method of changing a rail lifting head to lift different types of rail, without having to remove the entire rail lifting head, which may be too heavy for manual lifting. In contrast the head cartridge 100 may be lifted and fitted manually, if sufficiently light. Alternatively the head gate member 20 may be lowered by the rail lifting machine to engage on the head cartridge 100 to fit the new head cartridge 100.

To change a head cartridge 100 the head gate member 20 with the old head cartridge 100 may be lowered by the rail lifting machine towards a support surface. The rail support member 24 is removed or rotated so that there is nothing below the old head cartridge 100. Once the weight of the old head cartridge 100 is supported by the support surface, for example a beam or trestle, the old cartridge is removed by removing the locking pins 118 from the lugs 114. The head gate member 20 without the old head cartridge 100 may then be raised by the rail lifting machine clear of the old head cartridge 100, and then moved and lowered over the new head cartridge 100, which may also be supported on a support surface, so that the lugs 114 of the new cartridge engage in the slots 70 in the head top plate 26 of the head gate member 20. Locking pins 118 are inserted into the lugs 114 to secure the new head cartridge 100 in the head gate member 20.

This provides a simple method of changing the dimensions of the rail lifting head to suit different rail types, without having to replace the entire rail lifting head.

The invention is not limited to the specific embodiments described, and modifications and alternatives are possible. The shape, material and size of the various components can be modified.

The invention claimed is:

1. A rail lifting head comprising:

a head gate member defining a gate aperture;

a rail support member removably secured to the head gate member and adapted to support a rail vertically within the gate aperture; and a head cartridge adapted to be removably secured to the head gate member, wherein the head cartridge includes two pairs of opposed vertical rollers adapted to support the rail laterally within the gate aperture and a fixing adapted to removably secure the head cartridge to the head gate member, wherein the vertical rollers are each mounted for rotation about a vertical axis of rotation, and wherein the vertical axes of rotation are arranged to form a rectangular grid in plan.

2. The rail lifting head according to claim 1, wherein the opposed vertical rollers each extend between a lower horizontal plate and a common top plate of the head cartridge.

3. The rail lifting head according to claim 1, wherein the rail support member comprises a roller mounted for rotation on a horizontal axis.

4. The rail lifting head according to claim 1, wherein the rail support member is adapted for rotation about a vertical axis at one end of the rail support member, such that the gate aperture may be opened and lowered over a rail.

5. The rail lifting head according to claim 1, wherein the head gate member includes a head top plate and two side walls extending down from the head top plate.

6. The rail lifting head according to claim 5, wherein the rail support member is coupled at a first hinge end of the rail support member to a first vertical shaft member which is mounted on the head top plate for rotation about a vertical axis, and which depends from the head top plate.

7. The rail lifting head according to claim 6, wherein the head gate member comprises a first head lever extending above the head top plate and rotationally fixed to the first vertical shaft member for controlling rotation of the first vertical shaft member.

8. The rail lifting head according to claim 7, wherein the rail support member is selectively retainable at a second end of the rail support member to a second vertical shaft member which is mounted on the head top plate for rotation about a vertical axis, and which depends from the head top plate, wherein the second end of the rail support member is engageable in an aperture provided at a lower end of the second vertical shaft member.

9. The rail lifting head according to claim 1, wherein the head cartridge is adapted to fit a tram rail, a first pair of the two pairs of opposed vertical rollers being spaced apart from a second pair of the two pairs of opposed vertical rollers by between 150 and 250 mm in a direction of the rail, and each pair of rollers being spaced apart transversely by between 150 and 200 mm, and wherein the fixing adapted to removably secure the head cartridge to the head gate member is adapted to secure a top plate of the head cartridge in close proximity to a head top plate of the head gate member.

10. The rail lifting head according to claim 1, wherein the head cartridge is adapted to fit a standard rail, a first pair of the two pairs of opposed vertical rollers being spaced apart from a second pair of the two pairs of opposed vertical rollers by between 50 and 150 mm in a direction of the rail, and each pair of vertical rollers being spaced apart transversely by between 100 and 150 mm, and wherein the fixing adapted to removably secure the head cartridge to the head gate member is adapted to secure a top plate of the head cartridge in close proximity to a head top plate of the head gate member.

11. The rail lifting head according to claim 1, wherein the head cartridge is adapted to fit a conductor rail, a first pair of the two pairs of opposed vertical rollers being spaced apart from a second pair of the two pairs of opposed vertical rollers by between 50 and 150 mm in a direction of the rail, and each pair of vertical rollers being spaced apart transversely by between 110 and 170 mm, and wherein the fixing adapted to removably secure the head cartridge to the head gate member is adapted to secure a top plate of the head cartridge at a spacing of between 25 and 50 mm from a head top plate of the head gate member.

12. The rail lifting head according to claim 1, wherein the head cartridge is adapted to fit a bullhead rail, a first pair of the two pairs of opposed vertical rollers being spaced apart from a second pair of the two pairs of opposed vertical rollers by between 50 and 150 mm in a direction of the rail, and each pair of vertical rollers being spaced apart transversely by between 100 and 150 mm, wherein the first pair of vertical rollers is between 100 and 150 mm in length and the second pair of vertical rollers is between 225 and 275 mm in length, and wherein the fixing adapted to removably secure the head cartridge to the head gate member is adapted to secure a top plate of the head cartridge at a spacing of between 25 and 50 mm from a head top plate of the head gate member.

13. The rail lifting head according to claim 1, wherein the fixing adapted to removably secure the head cartridge to the head gate member comprises one or more lugs attached to a top plate of the head cartridge and adapted to engage with associated slots provided in a head top plate of the head gate member.

14. A rail lifting apparatus comprising the rail lifting head according to claim 1, including a plurality of head cartridges each adapted to be removably secured to the head gate member, wherein each head cartridge includes the two pairs of opposed vertical rollers adapted to support the rail laterally within the gate aperture and the fixing adapted to removably secure the head cartridge to the head gate member.

15. The rail lifting apparatus according to claim 14, wherein the plurality of head cartridges comprises one or more of each of:

(a) a first head cartridge adapted to suit a tram rail where a first pair of the two pairs of opposed vertical rollers is spaced apart from a second pair of the two pairs of opposed vertical rollers by between 150 and 250 mm in a direction of the rail, and each pair of opposed vertical rollers is spaced apart transversely by between 150 and 200 mm;

(b) a second head cartridge adapted to suit a standard rail where a first pair of the two pairs of opposed vertical rollers is spaced apart from a second pair of the two pairs of opposed vertical rollers by between 50 and 150 mm in the direction of the rail, and each pair of opposed vertical rollers is spaced apart transversely by between 100 and 150 mm;

(c) a third head cartridge adapted to suit a conductor rail, the head cartridge including first and second pairs of opposed vertical rollers, the where a first pair of the two pairs of opposed vertical rollers is spaced apart from a second pair of the two pairs of opposed vertical rollers by between 50 and 150 mm in the direction of the rail, and each pair of opposed vertical rollers is spaced apart transversely by between 110 and 170 mm; and/or (d) a fourth head cartridge adapted to suit a bullnose rail where a first pair of the two pairs of opposed vertical rollers is spaced apart from a second pair of the two pairs of opposed vertical rollers by between 50 and 150 mm in the direction of the rail, and each pair of opposed vertical rollers is spaced apart transversely by between 100 and 150 mm, the first pair of opposed vertical rollers being longer than the second pair of opposed vertical rollers.

16. A method of lifting the rail using the rail lifting head according to claim 1, the method comprising:

securing the head cartridge to the head gate member using the fixing;

opening the gate aperture of the head gate member by removing or rotating the rail support member;

lowering the gate aperture over a portion of the rail raised above a ground surface;

closing the gate aperture of the head gate member by replacing or rotating the rail support member beneath the portion of the rail; and raising the rail lifting head to lift the rail on the rail support member.

17. The method of lifting the rail according to claim 16, the method including the step of selecting a head cartridge from a plurality of head cartridges before securing the selected head cartridge to the head gate member, each head cartridge of the plurality of head cartridges including the two pairs of opposed vertical rollers, the plurality of head cartridges comprises one or more of each of:

(a) a first head cartridge adapted to suit a tram rail where a first pair of the two pairs of opposed vertical rollers is spaced apart from a second pair of the two pairs of opposed vertical rollers by between 150 and 250 mm in a direction of the rail, and each pair of opposed vertical rollers is spaced apart transversely by between 150 and 200 mm;

(b) a second head cartridge adapted to suit a standard rail where a first pair of the two pairs of opposed vertical rollers is spaced apart from a second pair of the two pairs of opposed vertical rollers by between 50 and 150 mm in the direction of the rail, and each pair of opposed vertical rollers is spaced apart transversely by between 100 and 150 mm;

(c) a third head cartridge adapted to suit a conductor rail where a first pair of the two pairs of opposed vertical rollers is spaced apart from a second pair of the two pairs of opposed vertical rollers by between 50 and 150 mm in the direction of the rail, and each pair of opposed vertical rollers is spaced apart transversely by between 110 and 170 mm; and/or (d) a fourth head cartridge adapted to suit a bullnose rail where a first pair of the two pairs of opposed vertical rollers is spaced apart from a second pair of two pairs of opposed vertical rollers by between 50 and 150 mm in the direction of the rail, and each pair of opposed vertical rollers is spaced apart transversely by between 100 and 150 mm, the first pair of opposed vertical rollers being longer than the second pair of opposed vertical rollers.

* * * * *